United States Patent [19]

Flugge et al.

[11] 4,008,078

[45] Feb. 15, 1977

[54] LOW-CARBON RAIL STEEL

[75] Inventors: Jurgen Flugge; Wilhelm Heller, both of Rheinhausen, Germany

[73] Assignee: Firma Fried. Krupp Huttenwerke AG, Bochum, Germany

[22] Filed: Mar. 31, 1975

[21] Appl. No.: 563,982

[30] Foreign Application Priority Data

Apr. 3, 1974 Germany ..... 2416055

[52] U.S. Cl. ..... 75/124; 75/123 B; 75/123 J; 75/123 L; 75/123 N; 75/125; 148/12 F; 148/36

[51] Int. Cl.[2] ..... C22C 38/12

[58] Field of Search ..... 75/124, 125, 123 N, 75/123 B, 123 L, 123 J; 148/36, 12 F

[56] References Cited

UNITED STATES PATENTS

| | | | |
|---|---|---|---|
| 3,284,250 | 11/1966 | Yeo et al. | 75/124 |
| 3,388,988 | 6/1968 | Nagashima et al. | 148/36 |
| 3,726,724 | 4/1973 | Davies et al. | 75/124 |
| 3,773,500 | 11/1973 | Kanazawa | 75/124 |
| 3,807,990 | 4/1974 | Gohda et al. | 75/124 |

*Primary Examiner*—Arthur J. Steiner
*Attorney, Agent, or Firm*—Burgess, Dinklage & Sprung

[57] ABSTRACT

A low-carbon rail steel having a tensile strength of at least 900 N/mm$^2$ and a yield point of at least 650 N/mm$^2$ conmprising:

0.07 to 0.12% carbon
0.20 to 0.50% silicon
4.00 to 5.00% manganese
0.04 to 0.12% niobium
0.007 to 0.012% nitrogen
0.005 to 0.025% metallic aluminum, the balance being iron with the usual low impurities; a steel rail having the composition of such steel and a method for producing the steel rail.

11 Claims, No Drawings

LOW-CARBON RAIL STEEL

BACKGROUND OF THE INVENTION

1. Field of the Invention

This invention relates to a low-carbon rail steel having a tensile strength of at least 900 N/mm² and a yield point of at least 650 N/mm². More particularly, this invention relates to a low-carbon steel rail which steel composition is substantially free of chromium whereby the rail itself has improved tenacity or plasticity and is not damaged by wear at low temperatures by the use of high velocity traffic.

2. Discussion of the Prior Art

Low-carbon rail steel having heretofore been provided as evidenced by U.S. Pat. No. 3,290,183. Therein there is disclosed the formation of a low-carbon rail steel containing 0.05 to 0.25 weight percent carbon, 0.1 to 1% molybdenum and particularly 2 to 6% chromium. The steel can also contain, in an alloy form, up to 1% silicon, up to 1.5% manganese, up to 1% nickel, up to 0.5% vanadium, up to 1% copper, up to 0.5% niobium, up to 0.5% titanium and up to 0.001% boron.

Unfortunately, this rail steel becomes quite brittle during the manufacture thereof when the same is cooled down from a hot rolling temperature. As this rail steel becomes too brittle during the air cooling it has to be cooled down from a temperature in the range of 500°–750° C to a temperature of 150°–200° C over a prolonged period of time which consumes more than 7 hours. The resultant rail steel has good tensile strength and can withstand weather and meets many other technological requirements for rails such as abrasion resistance, fatigue resistance and the like. The physical properties of the steel are due to its low carbon content coupled with its high chromium content and to the prolonged air cooling employed in its manufacture.

Inasmuch as prolonged and delayed air cooling lasting more than 7 hours noticeably disturbes the continuous production of steel rails it has become an object of the present invention to develop a rail without an expensive or extensive heat treatment which rail is made of a steel and has a tensile strength of at least 900 N/mm², preferably at least 110 N/mm² and a yield point of at least 650 N/mm².

It is also known to produce non-heat treated rails having some of the properties mentioned. Thus steels having good tensile strength have been provided employing elements known to improve tensile strength. Steels have been provided having a carbon content of 0.37 to 0.82 weight percent, a silicon content of under 0.80%, and mangenese content of 0.60 to 2.10 percent and a chromium content under 1.7%. Such steels can also contain alloying elements such as molybdenum, vanadium, nickel and titanium. Such non-heated steels have a pearlitic structure and attain tensile strengths of up to 1100 N/mm². These rails have a substantially favorable abrasion characteristic. See German Offenlengungsschrift 1 239 110.

Apart from abrasion resistance and fatigue strength characteristics a prime concern of rail steels is their plasticity and their resistance to rupture. Here consideration must be given to the fact that rails comprise a base, web and a top and have a complicated profile with clear differences in cross-section and shape. Thus damage in colder weather is often found which can be due to an unfavorable tenacity in steel. This damage is of the type which is worsened by high velocity traffic on the steel rail.

It therefore became an object of this invention to provide an improved steel rail which has excellent tensile strength, abrasion resistance and fatigue resistance and which had the desired tenacity whereby it would not be damaged in colder weather even under conditions of high velocity traffic. It also became desirable to provide such a steel which did not depend upon a high chromium content and/or an expensive or extensive heat treatment and/or cooling and, more especially, it became desirable to provide a steel of the type above described having a particularly high resistance against rupture and good plasticity (tenacity).

SUMMARY OF THE INVENTION

In accordance with this invention there is provided such a low-carbon containing steel useful as a rail steel having a high tensile strength of at least 900 N/mm² and a yield point of at least 650 N/mm² which steel comprises:

0.07 to 0.12 weight percent carbon
0.20 to 0.50 weight percent silicon
4.00 to 5.00 weight percent manganese
0.04 to 0.12 weight percent niobium
0.007 to 0.012 weight percent nitrogen
0.005 to 0.025 weight percent metallic aluminum, the balance being iron with the usual low impurities.

In accordance with this invention it has been discovered that if such a steel is formulated from known components which supply the elements indicated that rail steels can be provided having excellent tensile strength and yield point characteristics as well as the desired abrasion resistance and fatigue resistance. Generally speaking, the steels are provided by supplying a source of the elements indicated together with iron and the elements are maintained in the molten form under the usual steel making conditions until the desired steel is provided. This raw steel thereafter be hot rolled at first at about 1.100° C to 1.200° C for instance and later on a temperature of, for example, 900° to 1.100° C, preferably 950° to 1.050° C, into the rail. The so hot rolled rail can thereafter be quenched down to normal temperatures employing either a fluid, e.g., water quench or an air quench. Quenching is performed so as to cool the hot rolled rail, normally from a temperature of between 950° to 600° C, preferably 800° to 700° C down to a temperature of between 100° and 20° C either cooling in air in 1 hour to 2 ½ hours or preferably quenching in water having a normal temperature. There is thus provided a rail steel having substantially improved physical characteristics which can be provided without employing a process which requires a special heat treatment and/or cooling consuming a minimum of 7 hours.

In accordance with the invention the steel composition can additionally contain certain elements which improve the overall characteristics of the steel. Thus the steel can contain from 0 to 2 weight percent copper, from 0 to 0.5 weight percent molybdenum, from 0 to 2 weight percent zirconium, from 0 to 0.01 weight percent boron and from 0 to 0.3 weight percent titanium, the remainder being iron with the usual impurities. Niobium my be replaced by vanadium up to 0.4%.

Preferably, the minimum proportion of carbon employed is such so as to adjust the carbon content of steel to between 0.09 and 0.12 weight percent carbon.

The minimum amount of manganese desired is 4.5 weight percent. A preferred composition is characterized by having a minimum proportion of niobium of 0.05% and a minimum proportion of molybdenum of 0.3 weight percent. Generally speaking, the composition is substantially free, preferably entirely free of chromium. Generally, the chromium content will be less than 0.35% by weight.

In the refining of the steel to provide the rail steel of the invention it is expedient to provide for a low hydrogen content in the steel. For this purpose a series of hydrogen removal processes can be employed. The steel can be melted low in hydrogen and/or it can be reduced by one of the known steel degassing treatments so as to reduce the relative amounts of hydrogen to desired smaller values. Another procedure resides in precipitating the rolled rails for the purpose of removing hydrogen at room temperature or increased temperature in known manner.

Surprisingly, the steels have a particularly good resistance against rupture which can occur at low temperatures when the rail steel is quenched in water after hot rolling. This indicates that the resultant have the desired properties in respect of abrasion resistance, fatigue resistance and tenacity. These properties can be adjusted at low temperatures as will appear from the data in the tables below.

In order to more fully illustrate the nature of the invention and the manner of practicing the same the following examples are presented:

EXAMPLES 1–6

For the purpose of demonstrating the improved characteristics of the steels of the invention vis-a-vis steels made according to prior art techniques 6 steels of various compositions pursuant to the invention were made. Additionally steels, steel Nos. 1 and 2 were made according to known procedures for the manufacture of rail steels which do not have to undergo a long heat treatment, i.e., they were unquenched rails. In Table 1 below there is set forth the chemical composition of the prior art type steels (steels 1 and 2) vis-a-vis steels made pursuant to the present invention. In Table 2 there is set forth in tabular form the various physical properties of these steels from which it can be seen that the steels of the present invention have consistently a higher yield point and generally have a higher tensile strength than the steels of the prior art. The elongation characteristics of the steels of the present invention coupled with the reduction of air particularly distinguish the steels of the invention over prior art type steels. The impact DVM and the ISO-V values also markedly distinguish the rail steels of this invention over the prior art.

Table 1

Chemical Composition of the Rail Steels

| Steel No. | Treatment State | C | Si | Mn | Cu | Cr | Nb | V | N | Mo | Remarks | |
|---|---|---|---|---|---|---|---|---|---|---|---|---|
| 1 | Air cooling (L) | 0.75 | 0.25 | 1.1 | — | — | — | — | 0.005 | — | Rail class | Prior Art |
| 2 | (L) | 0.73 | 0.60 | 1.0 | — | 1.1 | — | — | 0.007 | — | Rail special class | |
| 3 | Air cooling (L) | 0.07 | 0.30 | 4.5 | — | — | 0.1 | — | 0.011 | — | Object of application | |
| 4 | or | 0.08 | 0.42 | 4.6 | — | — | 0.11 | — | 0.011 | — | " | |
| 5 | water | 0.07 | 0.28 | 4.2 | — | — | 0.1 | — | 0.012 | — | " | |
| 6 | quenching (W) | 0.09 | 0.29 | 4.5 | — | — | 0.05 | — | 0,012 | 0.37 | " | |
| 7 | according to | 0.12 | 0.28 | 4.1 | — | — | 0.10 | — | 0.012 | — | " | |
| 8 | Table 2 | 0.12 | 0.29 | 5.0 | — | — | 0.10 | — | 0.012 | — | " | |

All melts contain 0.005 to 0.25 % Al.

Table 2

Mechanical Properties of the Rail Steels

| Steel No. | Treatment state Air cooling (L) Water quenching (W) | | Yield Point N/mm² $\sigma_{0.2}$ | Tensile Strength N/mm² $\sigma_\beta$ | Elongation $\delta 5$ % | Reduction of Area 4 % | Impact DVMF Test −30° C Joule | Value[1] ISO-V +20° C Joule | Bending change strength $\sigma$BW N/mm² |
|---|---|---|---|---|---|---|---|---|---|
| 1 | L | Prior art | 550 | 962 | 13.5 | 23 | 9 | 9 | 325 |
| 2 | L | | 676 | 1130 | 11.4 | 22 | 9 | 8 | 370 |
| 3 | L | | 775 | 1079 | 16.4 | 67 | 137 | 54 | 421 |
| 4 | L | | 1020 | 1069 | 16.5 | 57 | 118 | 42 | 483 |
| 5 | L | | 728 | 917 | 17.8 | 72 | — | 32 | — |
| | W | | 966 | 1117 | 16.3 | 70 | — | 36 | |
| 6 | W | | 1005 | 1189 | 16.3 | 70 | — | 13 | |
| 7 | L | | 880 | 1086 | 15.8 | 64 | 92 | 11 | |
| | W | | 1041 | 1230 | 15.7 | 66 | 105 | 13 | |
| 8 | L | | 1077 | 1266 | 16.1 | 62 | 14 | 6 | |
| | W | | 1064 | 1261 | 15.9 | 64 | 96 | | |

[1]As defined in DIN (German Industrial Norm) 50115.

The previously known high-carbon steels 1 and 2 have good tensile strength but have poor values for tenacity (plasticity). The reduction of the area, as well as the impact value, for these steels is low so that these steels are prone to rupture, especially when rails made thereof are subjected to high velocities at low temperatures. In contrast thereto, the rail steels 3 to 8 have good technological properties for use as rail steels in addition to having good yield point and tensile strength values. The reduction of area is considerably more than 50% and the impact value according to the DVMF test employed in West Germany or the internationally known ISO-V test shows notably good results at temperatures of -30° respectively at room temperature. Moreover, the bending change strength is nearly over 400 N/mm² as the steel numbers 3 and 4 show. In contrast thereto the known steels 1 and 2 are clearly less than 400/mm².

It will be observed that in column 2 of Table 1 the treatment state after hot rolling is given. The cooling in air is labeled with (L) and the water quenching with (W). It is considered surprising that the impact value of the rail steels 5(W), 6(W), 7(W) and 8(W) quenched in water is higher than the same rail steel when cooled in air. Therefore, water quenching is preferred with respect to the increased resistance to rupture of the so treated rail.

When cooling in air, the structure shows bainit and ferrite structures whereas cooling in water is abrupt and shows exclusively bainite structures, the last mentioned structure having, however, a better resistance to rupture than the structure resulting from air cooling.

The rail steel according to the invention is not prone to hardening when welded. In connection with the passage of wheels thereover it shows no tendency to form friction martensite layers and is characterized by good plasticity (tenacity) in use.

What is claimed is:

1. A low-carbon rail steel having a tensile strength of at least 900 N/mm² and a yield point of at least 650 N/mm² consisting essentially of:

0.07 to 0.12 weight percent carbon
0.20 to 0.50 weight percent silicon
4.50 to 5.00 weight percent manganese
0.04 to 0.12 weight percent niobium
0.007 to 0.012 weight percent nitrogen
0.005 to 0.025 weight percent metallic aluminum, the balance being iron with the usual low impurities, said steel having a Cr content less than 0.35% by weight.

2. A low-carbon steel according to claim 1 additionally containing copper up to 2 weight percent.

3. A low-carbon steel according to claim 1 additionally containing molybdenum up to 0.5 weight percent.

4. A low-carbon steel according to claim 1 additionally containing zirconium in an amount up to 0.2 percent by weight.

5. A low-carbon steel according to claim 1 additionally containing boron in an amount up to 0.01 weight percent.

6. A low-carbon steel according to claim 1 additionally containing titanium up to 0.3 weight percent.

7. A low-carbon steel according to claim 1 additionally containing vanadium up to 0.4 percent by weight.

8. A rail having the composition of claim 2.

9. A steel according to claim 2 wherein the carbon content of said steel is between 0.09 and 0.12 weight percent carbon.

10. A steel according to claim 2 having at least 0.05% by weight niobium.

11. A steel according to claim 10 additionally containing molybdenum in an amount from 0.3 to 0.5% by weight.

* * * * *

UNITED STATES PATENT AND TRADEMARK OFFICE

CERTIFICATE OF CORRECTION

PATENT NO. : 4,008,078

DATED : February 15, 1977

INVENTOR(S) : Jurgen Flugge et al

It is certified that error appears in the above-identified patent and that said Letters Patent are hereby corrected as shown below:

[57] Abstract, line 3, "conmprising" should read -- comprising --.

Column 1, line 53, "mangenese" should read -- manganese --.

Column 6, line 25 (claim 8, line 1), "2" should read -- 1 --.

Column 6, line 26 (claim 9, line 1), "2" should read -- 1 --.

Column 6, line 29 (claim 10, line 1), "2" should read -- 1 --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*